United States Patent [19]

Rosin et al.

[11] 4,224,979

[45] Sep. 30, 1980

[54] AUTOMATIC FOUNDRY SYSTEM

[75] Inventors: George C. Rosin, South Euclid; Robert E. Kulon, Willowick, both of Ohio

[73] Assignee: McNeil Corporation, Akron, Ohio

[21] Appl. No.: 846,694

[22] Filed: Oct. 31, 1977

[51] Int. Cl.[3] ..... B22D 5/00; B22D 33/00; B22D 47/00

[52] U.S. Cl. ..... 164/130; 164/137; 164/324; 164/329

[58] Field of Search ..... 164/18, 130, 131, 137, 164/167, 168, 269, 322-324, 329-331

[56] References Cited

U.S. PATENT DOCUMENTS

| | | | |
|---|---|---|---|
| 2,229,492 | 1/1941 | Christensen et al. | 164/167 |
| 2,798,267 | 7/1957 | Anderson | 164/323 X |
| 3,254,376 | 6/1966 | Burnett | 164/323 |
| 3,273,210 | 9/1966 | Taccone | 164/18 X |
| 3,612,159 | 10/1971 | Galinsky | 164/324 |
| 3,743,004 | 7/1973 | Becke | 164/137 X |
| 3,821,978 | 7/1974 | Kauffman | 164/323 X |
| 3,955,613 | 5/1976 | Lund | 164/130 |
| 3,989,094 | 11/1976 | Gorenflo et al. | 164/324 |
| 4,054,172 | 10/1977 | Hansberg | 164/324 X |

*Primary Examiner*—Robert D. Baldwin
*Assistant Examiner*—J. Reed Batten, Jr.
*Attorney, Agent, or Firm*—Watts, Hoffmann, Fisher & Heinke Co.

[57] ABSTRACT

A foundry for automatically making sand castings, in which a metal casting and sand cake are transferred to a container after partial cooling and are carried with the container to a storage zone to cool for a time independent of any restrictions imposed by the conveying path, conveying speed, or cooling time required by other castings being processed. During handling and cooling, the integrity of the sand cake about the casting is maintained to provide cooling characteristics desirable for complex castings with variations in wall thickness. Specific structures handle and convey the sand cake and casting efficiently and reliably. Associated structure fabricates the sand molds and pours the castings, all in a continuous process.

18 Claims, 11 Drawing Figures

AUTOMATIC FOUNDRY SYSTEM

CROSS REFERENCE TO RELATED APPLICATION

Copending application Ser. No. 846,639, filed Oct. 31, 1977 and now U.S. Pat. No. 4,155,400 issued May 22, 1979, entitled "Ladle", George C. Rosin and Robert E. Kulon, inventors, discloses a hot metal monorail carrier for filling moving molds conveyed in the system disclosed herein. Said application is hereby incorporated herein by reference.

BACKGROUND

1. Field of the Invention

This invention relates to an automatic system for handling and cooling castings.

2. Prior Art

Automatic foundries find use in high volume applications, for example, in the manufacture of automotive engine castings. In some instances two or more different castings may be made on the same line, requiring different cooling cycles. Where the casting is complex is shape, with varying wall thickness, controlled cooling is critical to the casting quality. On a typical conveying line for cooling castings, the cycle time is limited for all castings to the cooling time required by the slowest to cool. This often makes the mixing of different castings on the same line inpractical. Moreover, a conveying line of sufficient length is required to allow adequate time for cooling. Where this time is substantial, a large number of mold cars for carrying the castings is required.

Also, with complex castings, it is best to cool the casting within the sand cake in which it is made. Attempts to remove castings and sand cakes from mold cars and flasks while maintaining the integrity of the sand cake have not been very successful. As a result, where castings have been removed from the mold cars and flasks for cooling, the metallurgic quality has usually suffered.

From the above, it will be apparent that a need exists for the handling of molds in an automatic foundry in a way that allows a variable cooling period and that allows automated handling of castings and sand cakes without adversely affecting the quality of the casting.

SUMMARY OF THE INVENTION

The present invention provides flexibility of cooling time for castings in an automatic handling system, utilizes many fewer mold cars and flasks than the castings in process, and maintains the integrity of the sand cakes during handling and cooling of the castings. Basically, this is accomplished through new and improved handling apparatus, an improved foundry layout, and the use of a cooling cycle that combines a fixed primary cooling time with a variable secondary cooling time for the castings, so that the total cooling time is independent of conveying limitations and so the conveying line itself need not accommodate all castings in process. In addition to the flexibility in cooling time this affords, it has the added benefit of permitting bypass of part of a cycle, e.g., the secondary cooling, following a temporary shut down of the foundry with castings in the primary cooling cycle, which then need no further cooling.

The improved layout and handling facilities of this invention provide the following interfaces: a mold conveying line is interfaced with a pouring ladle, a subsequent primary cooling portion of the mold conveying line is interfaced with a container line that receives partially cooled castings, the container line is interfaced with a conveyor loop that carries the containers to a storage zone for additional or secondary cooling, and the conveyor loop is interfaced with handling apparatus for unloading containers of cooled castings and conveying them to shake-out apparatus to remove the sand cakes.

At the interface between the mold conveying line and the pouring ladle, moving molds are filled and then, as they are moved along the conveying line, are allowed to cool sufficiently for removal from the mold cars.

At the interface between the mold conveying line and sand cake container line, the partially cooled castings and sand cakes are removed from the mold cars and surrounding flasks and transferred to a container constructed to allow the casting to cool while retaining the integrity of the surrounding sand cake so the cooling is gradual and even. A novel construction of the container and transfer mechanism assures automatic removal and transfer without damage.

At the interface between the container line and the conveyor loop to the secondary cooling or storage zone, the containers are received by carriers that are programmed to carry the container with its particular casting, which may be one of several different castings being made concurrently on the mold line, to the storage zone where the container is deposited at a predetermined location for a predetermined time for the casting to complete its cooling cycle. The location and time are programmed into a computer that will actuate magnetic switches that control the carrier in depositing and retrieving containers. Thus, the carrier retrieves a different container before leaving the storage zone and returning to the location where it interfaces with the container line. The cooling time for the casting retrieved from the storage zone was independent of the length of the conveying path or the time required for cooling of any other casting. The flexibility of cooling time provided in this zone permits use of only the minimum cooling time on the mold line that is required for subsequent handling purposes, rather than for casting quality.

The interface between the conveyor loop and the handling apparatus for unloading of cooled castings from their containers is, in the preferred embodiment, at the same location as the interface between the conveyor loop and the container line. As a result, at the time the container brought from the storage zone is removed from the conveyor to the handling apparatus for unloading the container, a container with a hot casting can be concurrently transferred to the same carrier, which then proceeds again to the storage zone. In this way, all movement of the carriers, except for some movement within the storage zone itself, is utilized to move containers and common apparatus can be used for both concurrent transfers.

In a broad form of the invention, the conveyor loop for the secondary cooling or storage zone is not necessarily comprised of a single conveyor as contemplated in the preferred embodiment, but rather separate conveyors can move containers into storage and then out of storage.

The above and other features and advantages will become more apparent from the detailed description that follows, when considered in connection with the accompanying drawings.

DETAILED DESCRIPTION

General Arrangement

Figure 1A:
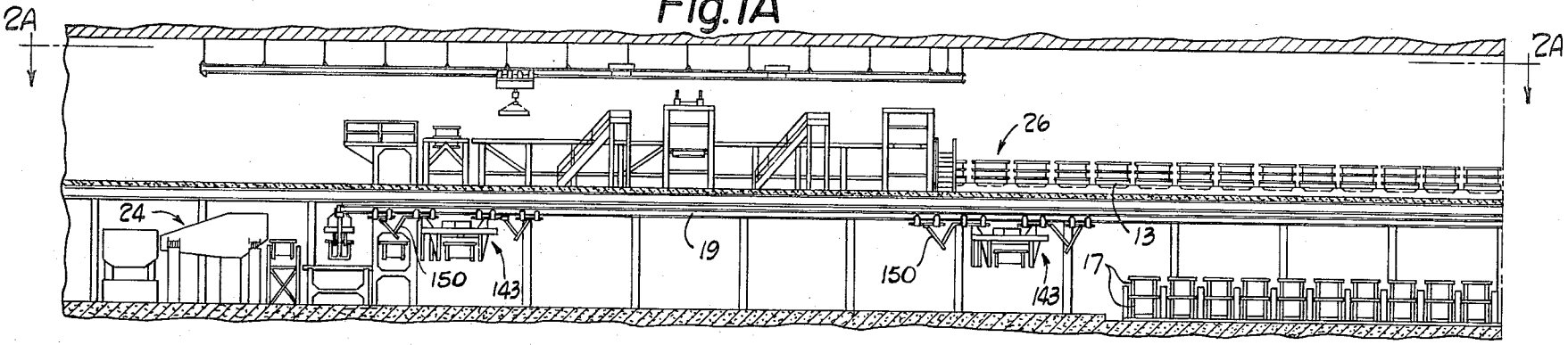
FIGS. 1A and 1B are elevational views of a two-story foundry incorporating an automatic handling system for castings and embodying the present invention.
Figure 2A:
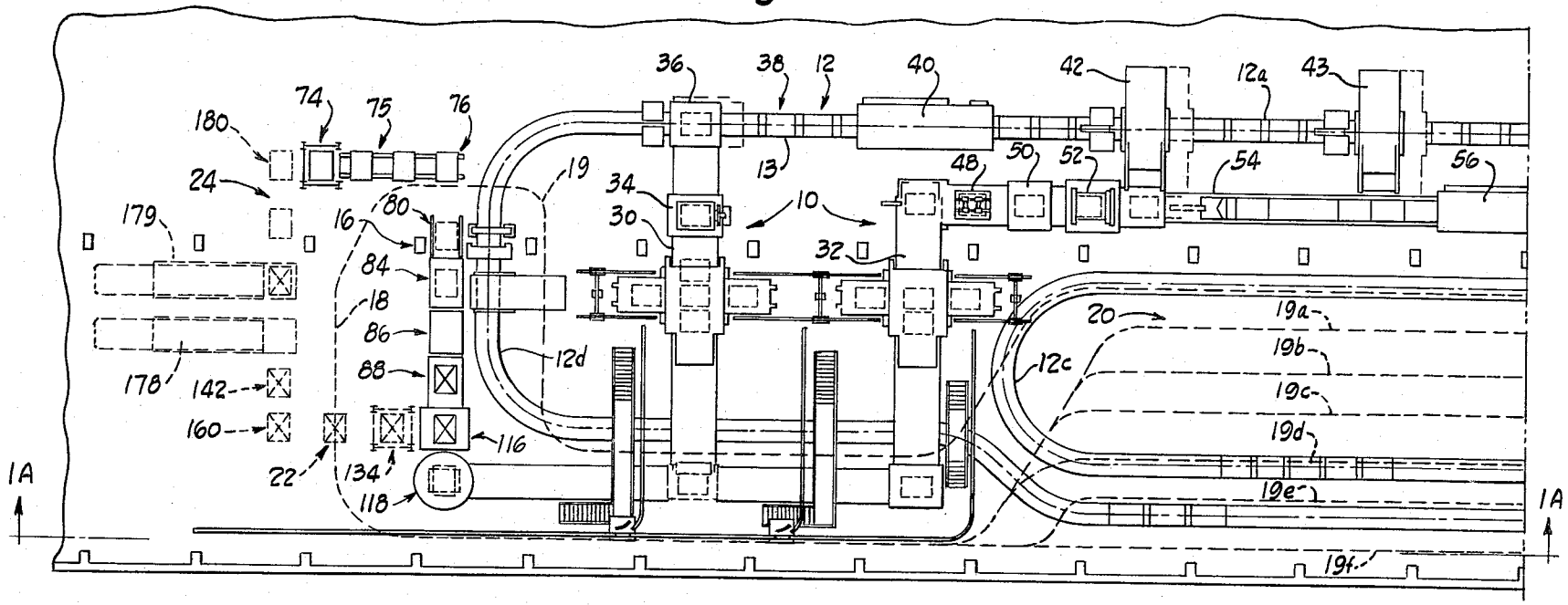
FIGS. 2A and 2B are plan views of the foundry of FIGS. 1A and 1B taken along the lines 2A—2A and 2B—2B, respectively.
Figure 1B:
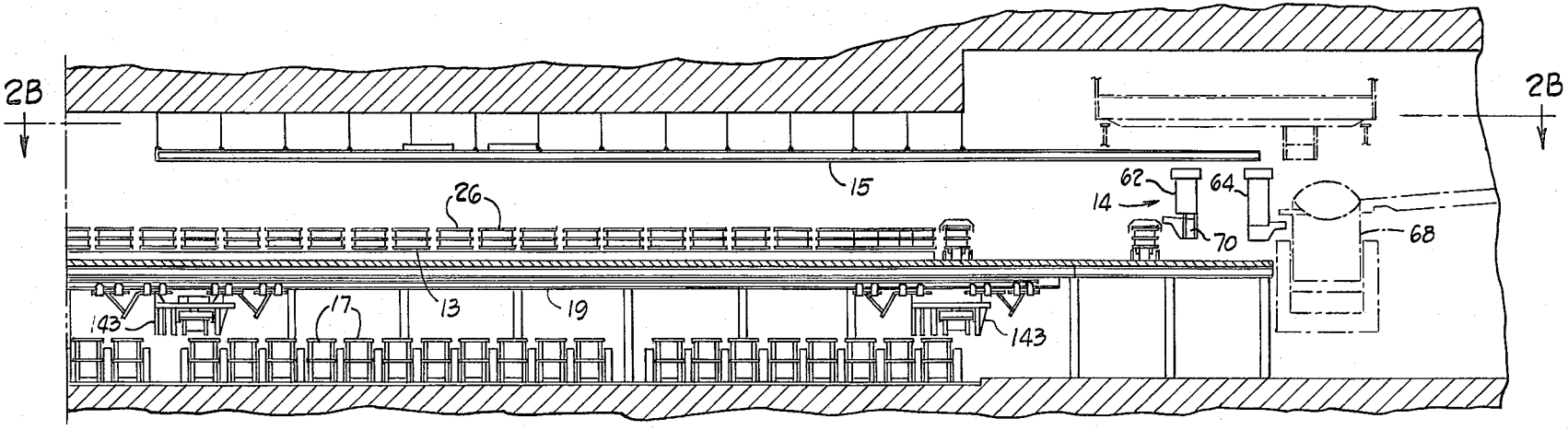
Figure 2B:
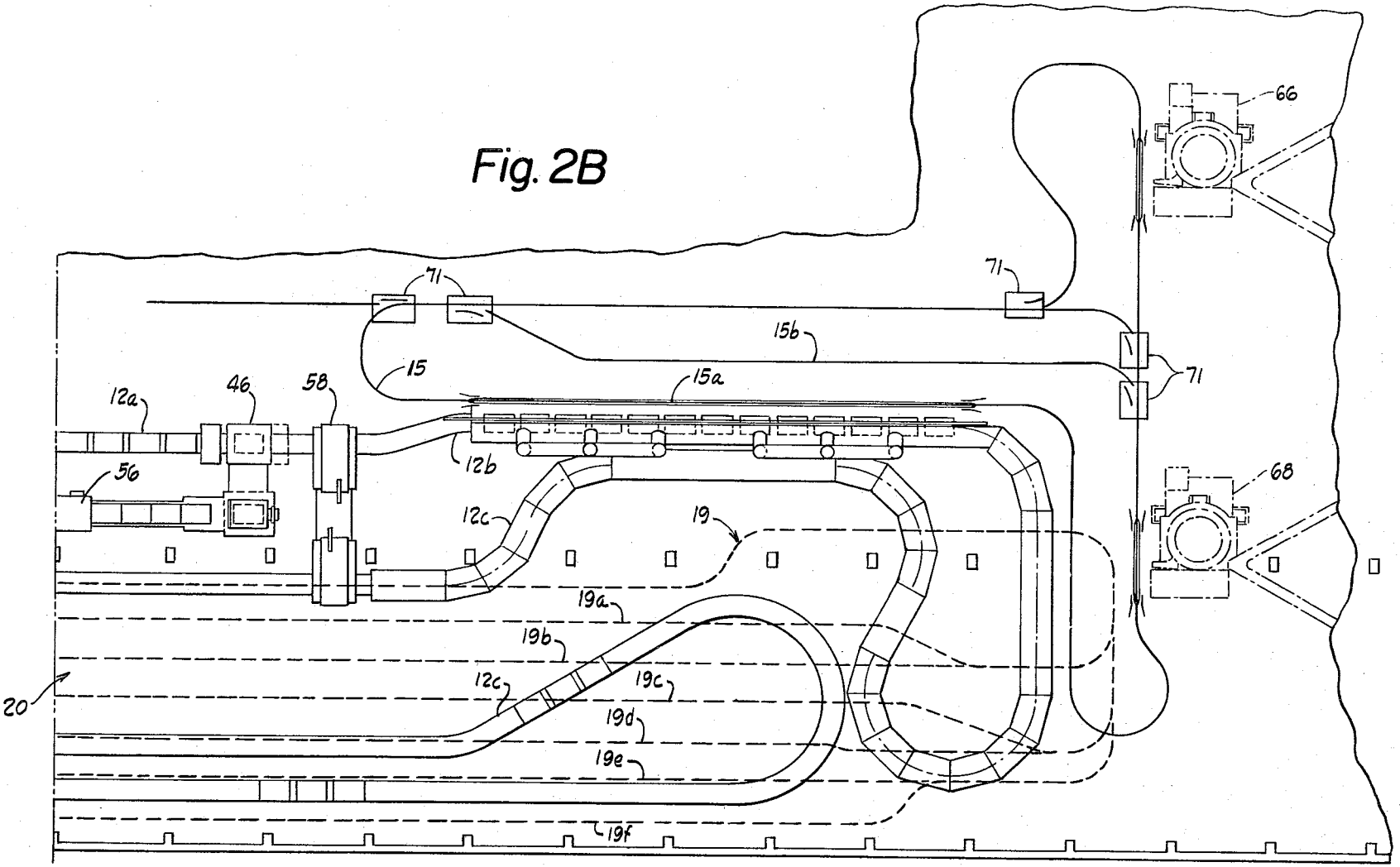

The general arrangement of a foundry embodying the present invention is illustrated in FIGS. 1A, 1B and 2A, 2B, and as shown, occupies two vertical levels or floors (see FIGS. 1A, 1B), the structures on the lower level being shown in phantom in FIGS. 2A, 2B.

The system shown is comprised of automatic mold making apparatus indicated generally by reference numeral 10 (FIG. 2A) for fabricating molds to be filled; a mold conveying line indicated generally by reference numeral 12, with car conveyors 13 for carrying molds through a filling operation and primary cooling stage; a hot-metal monorail carrier indicated generally by reference numeral 14 (FIG. 1B) and including a loop or path 15 along which the carrier is moved for pouring hot metal into molds; a sand cake transfer system indicated generally by reference numeral 16 (FIGS. 2A and 4), where a sand cake and mold are transferred from the mold cars 13 to mold containers 17 (shown in more detail in FIG. 6); a monorail carrier system indicated generally by the reference character 18 (FIG. 2A) for carrying the mold containers 17, and which includes a track system 19 extending through a mold storage zone 20 in which molds may be deposited for cooling; a container transfer apparatus indicated generally by reference numeral 22 (FIGS. 2A and 5), which transfers mold containers 17 from the sand cake transfer system 16 to the monorail carrier system 18, and from the monorail carrier system 18 to shakeout apparatus; and a container-return and mold-shakeout system, indicated generally by the reference numeral 24 (FIGS. 2A and 5), which receives containers 17 and cooled castings from the container transfer apparatus 22 and returns the containers to the sand cake transfer system 16. Coordinated operation of the above conveyors and systems is continuous and automatic and provides a casting production system of high efficiency and flexibility, and that assures a high quality casting. Operation is monitored and coordination controlled by a computer having external sensors and programmed for the desired sequence of operations.

Sand molds 26 made by the automatic mold making apparatus 10 are transferred to mold cars 13 as they move along the mold conveying line 12, after which molten metal is poured from the moving carrier 14. The mold conveying line 12 is circuitous to afford adequate time for primary cooling of the castings prior to their being handled at the sand cake transfer system 16, where the sand cake and casting are removed from surrounding flasks F and each is received in a container 17 for further cooling. Containers 17 with castings that have undergone primary cooling, but which require additional secondary cooling (the time of which may vary among castings being processed) are transferred by the container transfer apparatus 22 to the monorail carrier system 18 and carried to the storage zone 20 where they are left to cool. Containers already in the storage zone 20, containing cooled castings, are retrieved by the carrier system 18 and taken back to the container transfer apparatus 22. Retrieved containers are removed from the monorail carrier system 18 and taken to the container return mold shakeout system 24, where the containers are emptied, the sand cakes removed from about the castings, and the containers are returned to the sand cake transfer system 16.

Automatic Mold Making Apparatus

An automatic molding machine 30 (FIG. 2A), for producing the drag half of each mold 26 and an automatic molding machine 32 for producing the cope half are arranged adjacent the mold conveying line 12. In the preferred embodiment, each is arranged to permit the production of two different castings in alternating sequence by means of a two-pattern shuttle arrangement on both the drag and the cope molder. Machines of this type are commercially available and do not per se form a part of this invention.

At the molding machine 30, a drag flask is positioned in the machine, a pattern shuttle positions a casting pattern under the flask, the drag is filled with molding sand, jolted and squeezed. After pattern withdrawal, the drag mold is indexed out of the machine, passes under a strike-off to a drag mold rail over 34 and enters a "drag mold set on" unit 36 which places the drag mold on a mold car 13 of the continuous mold conveyor 12.

When the next drag flask enters the drag molder, if a different pattern is to be used, the pattern shuttle will position the different pattern under that flask. Thus in one mode of operation the drag molds can be produced in an alternating series.

A manual mold spray area 38 is located between the "set on" unit and a "skin dry" oven 40 along the conveyor 12. At the "skin dry oven" all of the liquid components of the spray on the drag mold are burned off or evaporated to dry the mold.

Two automatic core setter units 42, 43 are located along the conveyor 12. Each is capable of handling the full line capacity, but two are provided to handle the two different molds that can be produced. These setters place core assemblies into the molds. The drag mold then reaches a closing unit 46.

At the molding machine 32, a cope flask is positioned in the machine and a cope mold is made up with first one pattern and then the next flask with a different pattern where two different castings are being made on an alternating basis. The cope mold is then indexed out of the molder, under a strike-off, and into a sprue cutting station 48; then into a vent drilling station 50, a roll over 52, through a mold spray station 54 and into a skin dry oven 56.

The cope molds emerge from the oven and, after being rolled back, are moved to the mold closing unit 46 where the cope molds are placed on the drags as the drags travel through this unit on the continuous mold conveyor 12.

The conveyor 12 carries the closed mold through a pour-weight transfer unit 58 which places a pouring weight on top of the cope and the mold is ready for filling with molten metal.

Mold Conveying Line

The mold conveyor 12 is comprised of a series of mold cars 13 of basically known design that move along the predetermined path of the conveyor in a continuous loop. The path includes an initial portion 12*a* that extends along the mold making machines 30, 32, through the cope closer 46 and weight transfer unit 58; a subsequent portion 12*b* that is straight and parallel to a portion 15*a* of the pouring path 15 of the hot metal monorail carrier 14; a serpentine portion 12*c* that passes by a pour-weight lift off portion of the unit 58 and that provides adequate conveying length and time for a primary cooling cycle during which the castings cool sufficiently to be handled by the subsequent transfer equipment; and a final portion 12*d* that extends along the sand cake transfer system 16. The mold cars themselves are constructed to cooperate with the hot metal monorail carrier along the portion 12*b* of the conveying line, in a manner that assures coordinated movement between the monorail carrier and the car carrying a mold into which hot metal is being poured while both are moving. This construction and arrangement is shown in more detail in the copending application referred to previously. Movement of the mold cars along the path is continuous through a chain drive, of conventional construction. A conveying speed is established compatible with the pouring operation of the hot metal monorail carrier 14 and the cooling cycle required for primary cooling of the castings, with the length of the line being minimized to the extent possible, to reduce the number of mold cars required.

Hot Metal Monorail Carrier

The hot metal monorail carrier, indicated generally by reference numeral 14, includes two individual carriages 62, 64 (FIG. 1B), each independently driven and guided about the monorail loop 15, between two holding furnaces 66, 68 (FIG. 2B) and the straight pouring portion 15*a* of the monorail loop. Each carriage 62, 64 is identical and reference will be made to only carriage 62. The carriage 62 supports a ladle 70 that is filled at one of the holding furnaces 66, 68 and then carried to the pouring portion 15*a* of the conveying loop. The specific construction of the carriages, ladles and the manner in which they are coordinated with the moving mold cars and molds during pouring is disclosed in detail in the said copending application.

Briefly, the carriage 62 is driven independently by an air motor along the overhead monorail loop 15. In addition to the ladle 70, the carriage includes an operator's cab (not shown), from which an operator controls the movement of the carriage as well as the pouring of metal from the ladle. At the pouring portion 15*a*, the carriage is guided along the floor as well as along the overhead rail to assure stability during pouring. A retractable projection carried by the carriage engages the mold car carrying the mold to be filled and the drive motor of the carriage biases the projection against the car, so that both the carriage with its ladle and the car move at the same speed along the respective portions 15*a* of the monorail loop and 12*b* of the mold conveying line. During this time, the operator pours the hot metal from the ladle into the mold. Since the mold has a relatively small opening and less than the full contents of the ladle is poured into each mold, the pouring must be controlled accurately by the operator. In the preferred embodiment, a ladle construction specifically as shown in the aforementioned copending application is provided to facilitate this accuracy.

After one mold is filled, the carriage is advanced along the line of moving molds at a substantially faster rate than the molds to overtake and engage with the next mold. In the preferred embodiment, four molds are filled in this manner from a ladle of hot metal, after which the ladle exits the pouring portion 15*a* and returns to one of the holding furnaces for refilling. The two carriages 62, 64 and respective ladles are provided in the preferred embodiment to allow continued filling of molds while one ladle is being refilled. Track switches 71 are operable by the carriage operator to control the path of carriage movement to the furnaces 66, 68 or to direct a carriage to a track siding portion 15*b* when the carriage is idle.

Sand Cake Transfer System

Figure 3:
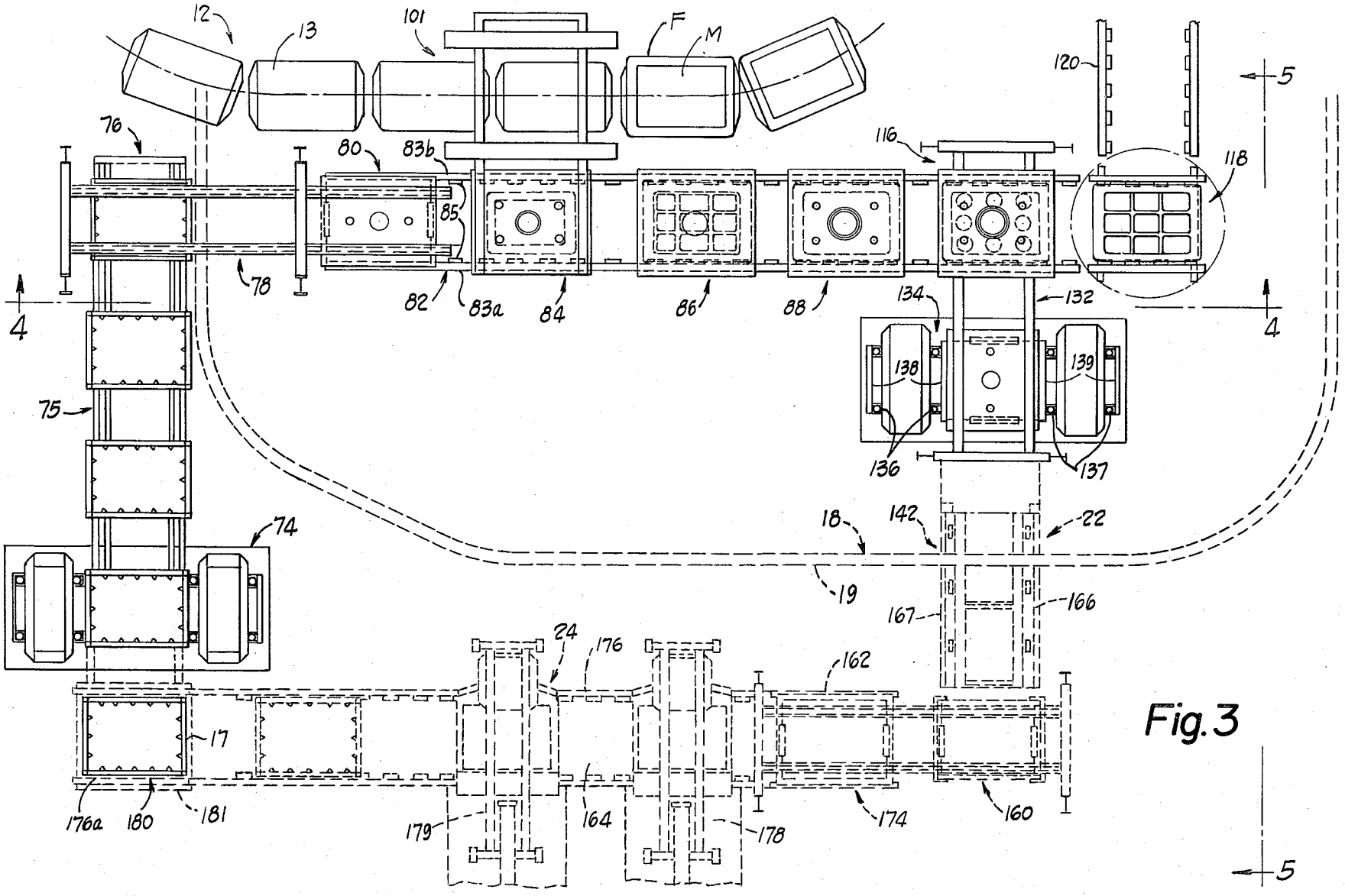
FIG. 3 is a plan view of a portion of the handling system shown at the left end of FIG. 2A where sand cakes are transferred to containers and where the container line interfaces with the secondary cooling or storage zone conveyor loop, with apparatus on the lower story of the foundry being shown in phantom.
Figure 4:
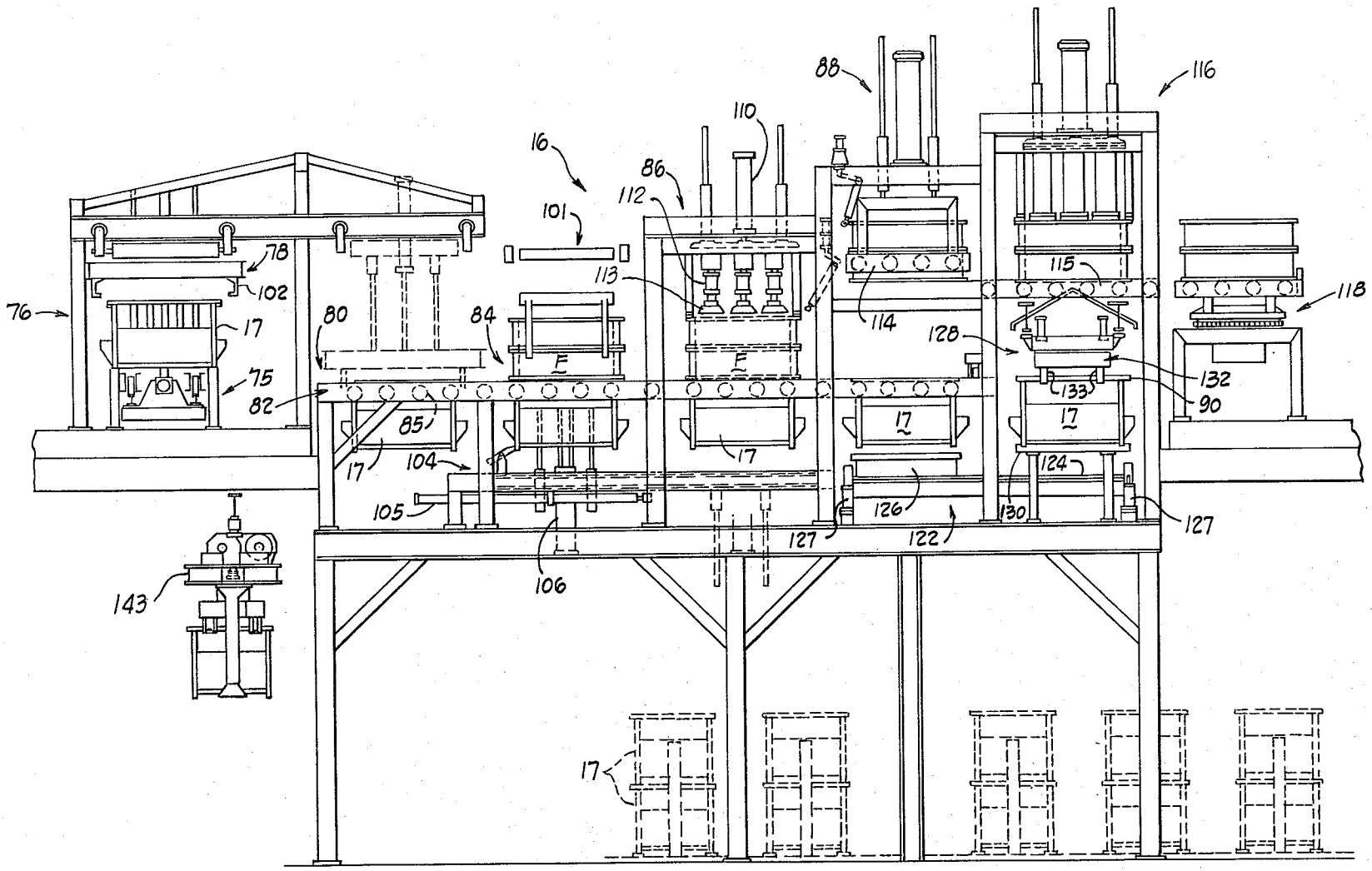
FIG. 4 is an elevational view of the sand cake transfer portion of the apparatus of FIG. 3, taken along the line 4—4 of FIG. 3.
Figure 5:
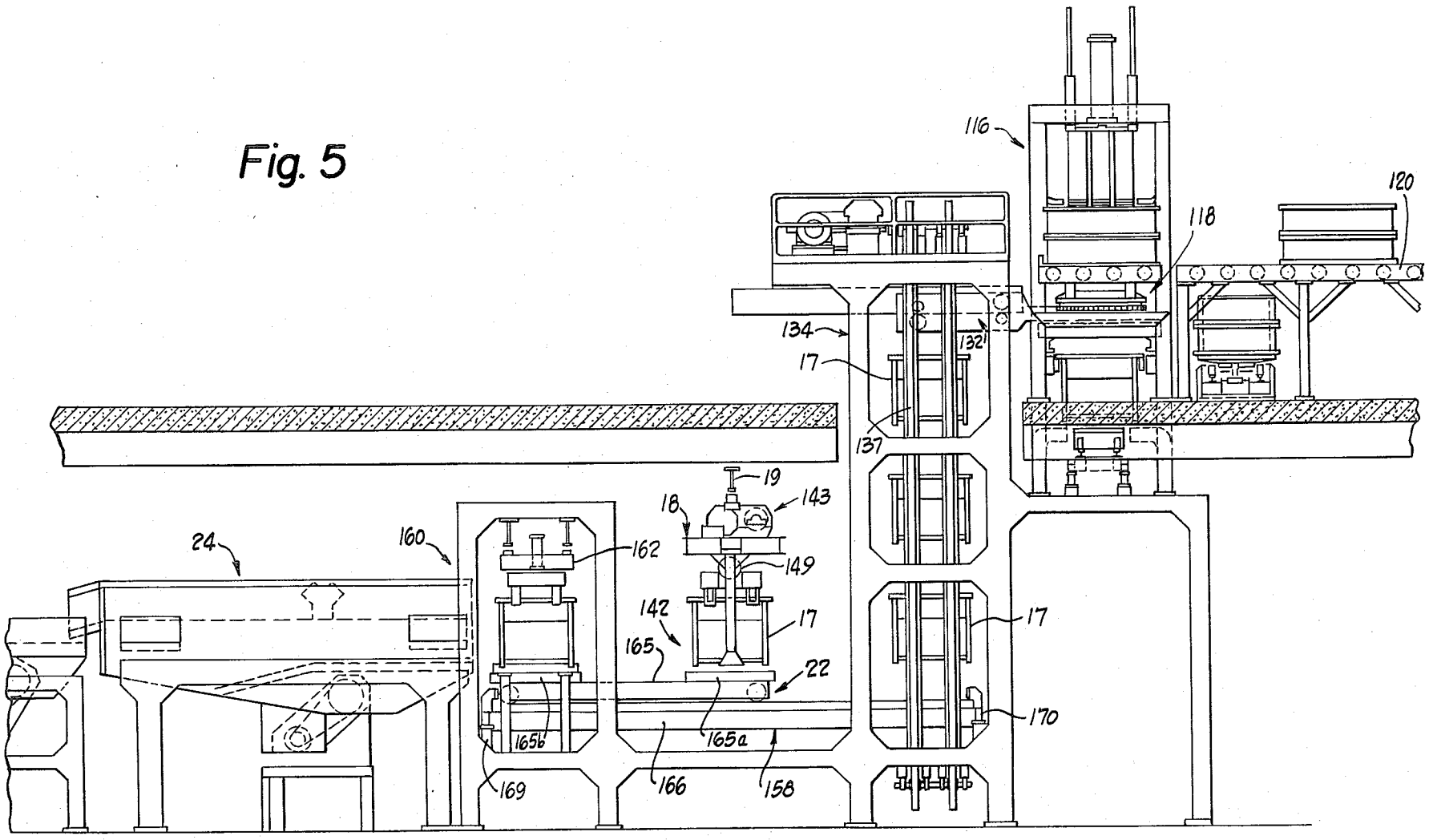
FIG. 5 is an elevational view taken along the line 5—5 of FIG. 3 showing, inter alia, apparatus for transferring containers to and from the conveyor loop for the secondary storage.

The sand cake transfer system generally indicated by reference numeral 16, is shown in detail in FIGS. 3 and 4. The system serves to transfer sand cakes and castings from the mold line 12 to the containers 17 for subsequent handling. In the embodiment shown, the sand cake transfer system is located on the upper level of the foundry, with the mold line 12.

Containers 17 are brought from the lower level of the foundry by an elevator 74 and then carried by a walking beam conveyor 75 to a lift off station 76. From the lift off station, each container is transferred one at a time by an overhead conveyor 78 to a container feed station 80. Transfer by the conveyor 78 is initiated by a signal produced by the walking beam conveyor each time it makes a forward stroke. A stub roll conveyor 82 receives the container at the container feed station and conveys it to a bottom board lift station 84, a sand cake transfer station 86 and a flask elevator station 88. For this purpose, the stub roller conveyor is arranged horizontally, and is constructed of two longitudinal beams 83*a*, 83*b* transversely spaced with inwardly facing driven stub rolls 85 to support and convey containers 17. The rolls at each station 80, 84, 86 and 88 are separately driven and at stations 84 and 86 can be declutched to be free running.

Figure 6:
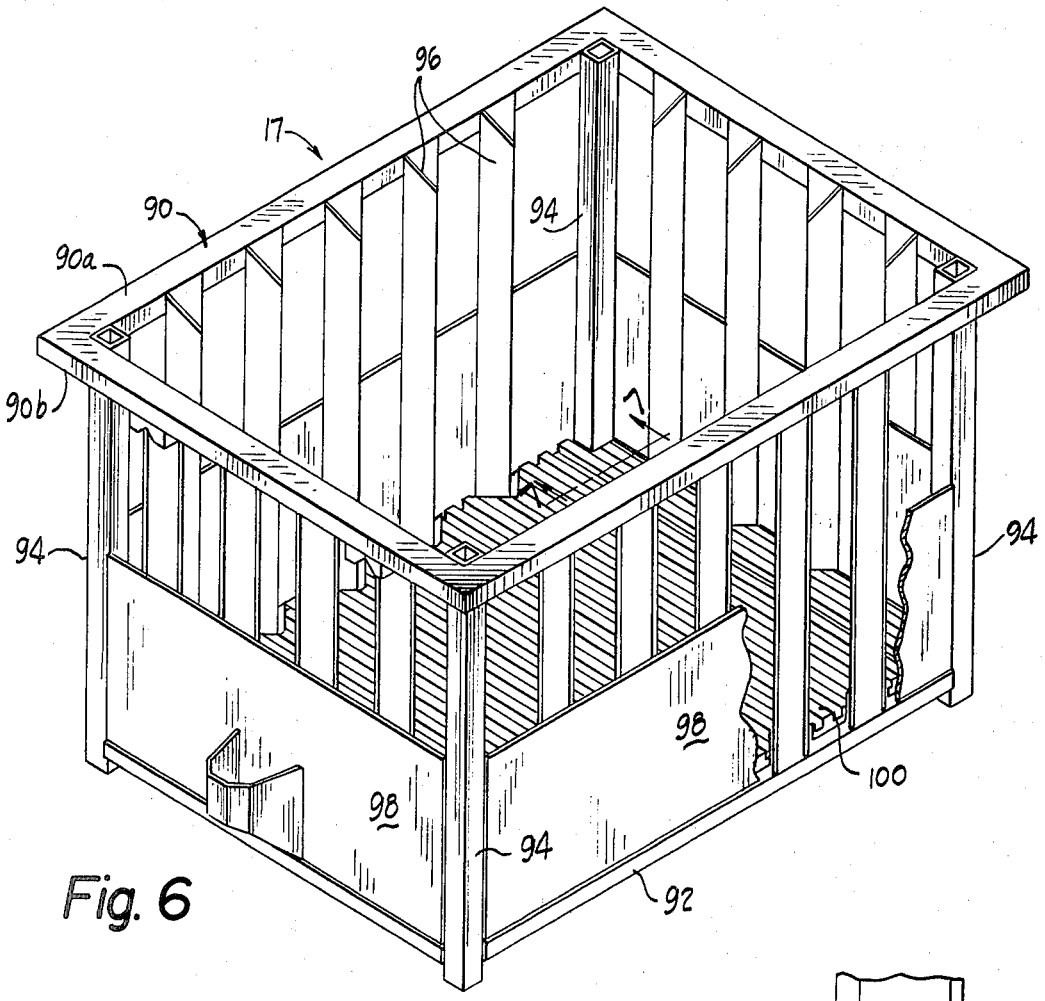
FIG. 6, is a perspective view of a container for receiving and conveying a casting and surrounding sand cake.
Figure 7:
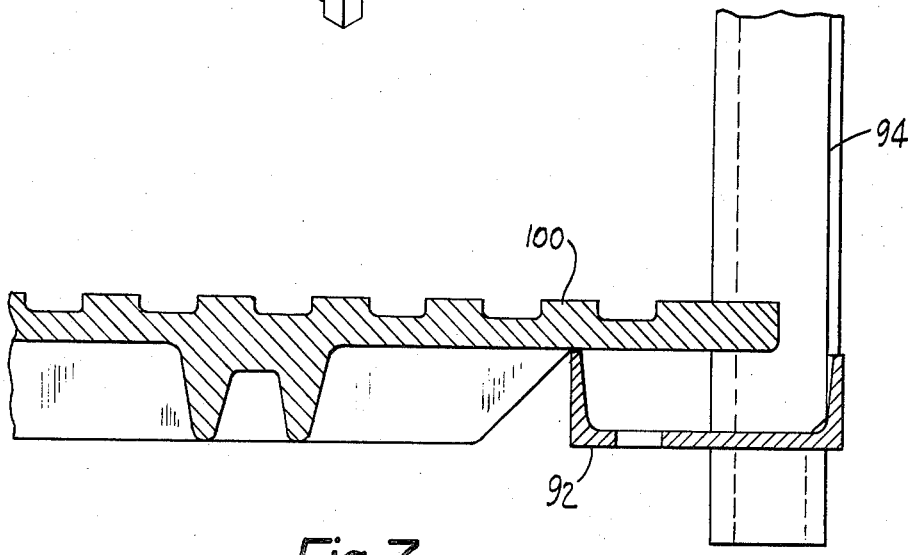
FIG. 7 is a partial sectional view taken along the line 7—7 of FIG. 6.

The containers 17 are best shown in FIG. 6, and are rectangular in plan. Each container has an upper rectangular rim or flange 90 with a flat top surface 90*a* and a flat bottom surface 90*b*; a rectangular perimeter channel 92 at the bottom, or base; four upright corner posts 94; and upright, spaced, side slats 96 that are triangular in cross section with apices facing inwardly beyond the inner perimeter of the upper rim or flange 90. Partial height side panels 98 enclose the bottom portion of the container. A bottom board 100 rests on the perimeter channel 92 and is movable vertically to a position flush with the top flange 90. The bottom of each corner post 94 extends below the bottom board to form support legs, and the top of each corner post is open to receive the bottom of the legs of another container, for stacking. The container 17 is preferably constructed of steel.

When a sand cake is received within the container, resting on the bottom board, the apices of the side slats 96 engage the outside surface of the sand cake to hold it firmly within the container. At the same time, the space between the side slats allow the sand cake and casting to cool. By virtue of the triangular cross-sectional shape of the side slats, the apices will firmly hold and locate the sand cake while yet allowing it to be received within the container in a vertical direction when it is transferred, without substantial friction as it slides into the container.

The bottom surface 90*b* of the top flange 90 is constructed to be supported on the stub rolls 85 of the stub roll conveyor 82, with the sides of the container depending between the channels 83*a*, 83*b* of the conveyor 82.

At the container feed station 80, the containers 17 are individually lowered one after another onto the stub roll conveyor 82 and are conveyed by driven rolls 85 to the bottom board lift station 84, which is adjacent a mold lift off station 101 of the mold line 12. This transfer of the container to the stub roll conveyor is achieved by supporting the container by an overhead grab device 102 of the overhead conveyor 78, which holds the container on the ends, permitting the container to be placed directly on the conveyor wheels of the conveyor 82. Cycling of the grab device and movement of the conveyor 78, once initiated, is in response to on-board logic of its control circuitry.

At the bottom board lift station, a mold-receiving shuttle 104 beneath the conveyor 82 is moved between the bottom board lift station and the transfer station 86 by a fluid actuator 105. The container 17 arrives at the lift station before the shuttle. In response to arrival of the shuttle 104 into position beneath the container at the bottom board lift station, an air cylinder 106 carried by the mold receiving shuttle lifts the bottom board 100 of the container to an upper position where it is flush with the top surface 90*a* of the flange 90.

At the mold lift off station 101, a mold M with its surrounding flask F is lifted slightly from a mold car at the station, moved at right angles to the mold line, and set on the raised bottom board of the container 17 at the bottom board lift station. This is done while the mold car is moving, by carrying the lift off apparatus on a carriage movable for a short distance with the mold car. Lift off apparatus of this type is available commercially. The mold is lifted only a slight distance during transfer, and the lift off apparatus is stopped before the mold is placed on the container. When the mold M is deposited on the bottom board of the container, the surrounding flask F of the mold rests upon the top 90*a* of the flange 90 of the container, while the sand cake itself rests directly upon the raised bottom board. Upon and in response to completion of mold transfer by the lift off apparatus at station 101, the mold receiving shuttle 104 moves with the container 17 and mold M along the stub roll conveyor 82 to the sand cake transfer station 86. The rolls at stations 84 and 86 are declutched during this movement. In response to arrival of the shuttle 104 at the sand cake transfer station 86, a punch down unit 110 applies pressure to the top surface of the mold with vertical cylinders 112 that move pressure compensating feet 113 against the top surface of the mold at locations to pass between cope bars of the mold assembly. As the cylinders are actuated and the feet move downward, the bottom board cylinder 106 of the mold receiving shuttle retreats under the greater downward pressure and the sand cake enters the container 17. During this movement, all six surfaces of the sand cake are confined at all times. The cylinder 106 develops only enough force to support the weight of the mold and therefore the punch down cylinder can only develop enough force to overcome the frictional holding force between the sand cake and the flask walls. Once the sand cake is completely transferred and the bottom board is at its lower position, resting upon the channel 92 of the container, the mold receiving shuttle is returned to its initial position in line with the bottom board lift station 84 and mold lift off station 101. The container 17 and the now empty flask F of the mold assembly that is resting upon the upper flange 90 must remain at the sand cake transfer station until the feet of the punch down apparatus are completely withdrawn from the flask. In response to raising of the punch down apparatus, the container with the empty flask on top is then moved by the stub roll conveyor 82 to the flask elevator station 88, where it hits a swing-away stop. As the container moves into the flask elevator station, a vertically movable stub roll section 114 receives the flask F and then lifts it from the container to the position shown in FIG. 4, transfers it by driving the stub rolls to a flask cleanout station 116 where it is supported on a stub roll conveyor 115 and the flask is cleaned. The conveyor 115 then carries it to a flask turntable 118, where the flask is rotated and then conveyed on a flask conveyor 120 (FIG. 3) to the automatic mold making apparatus.

Lifting of the empty flask at the flask elevator station 88 operates a limit switch and the loaded container 17 is indexed from the stub roll conveyor 82 by a transfer table assembly 122 located beneath the container and conveyor 82. The transfer table assembly 122 has a vertically movable track 124 and a car 126 that moves along the track. With the car beneath the container at the station 88, the track is raised by actuators 127 to lift the container from the stub roll conveyor. When the actuators are extended the car is moved by an actuator along the track to a position beneath a container transfer station 128, where the car locates the container directly over a fixed support 130, after which the track 124 is lowered to deposit the container on the support 130. The car is then returned to the position beneath the flask elevator station. In response to completion of the transfer to the support 130, an overhead conveyor 132 at the container transfer station picks up the container with grabs 133 that engage the flange 90 and deposits the container upon a container lowerator 134 (FIGS. 3 and 5), all under the control of on-board logic control circuitry.

The container lowerator 134 is comprised of two endless chain conveyors 136, 137 that face each other in spaced relationship, and have horizontal, parallel support bars 138, 139, which each engage one opposite undersurface 90b of the flange 90, so that the container is supported by both endless chain conveyors on the support bars 138, 139, which are movable downward under motor drive while maintaining their parallel, horizontally aligned, relationship. The lowerator is constructed to support a total of three containers at a time in vertical alignment, moving them downward to a container exchange shuttle station 142 where the containers are transferred to the monorail carrier system 18. When the overhead conveyor 132 completes its transfer of a container to the lowerator, it produces a signal to the control computer indicating that the container is on the lowerator. However, the computer must coordinate this signal with a signal indicating the bottom position of the lowerator at station 142 has been cleared before it initiates downward indexing of the lowerator.

Monorail Carrier System and Secondary Cooling Zone

The monorail carrier system 18 carries containers 17 from the exchange shuttle station 142 to the secondary cooling or storage zone 20 and back. Containers 17 with hot castings are picked up and containers with cooled castings are delivered by carriers 143 of the monorail system.

Figure 8:
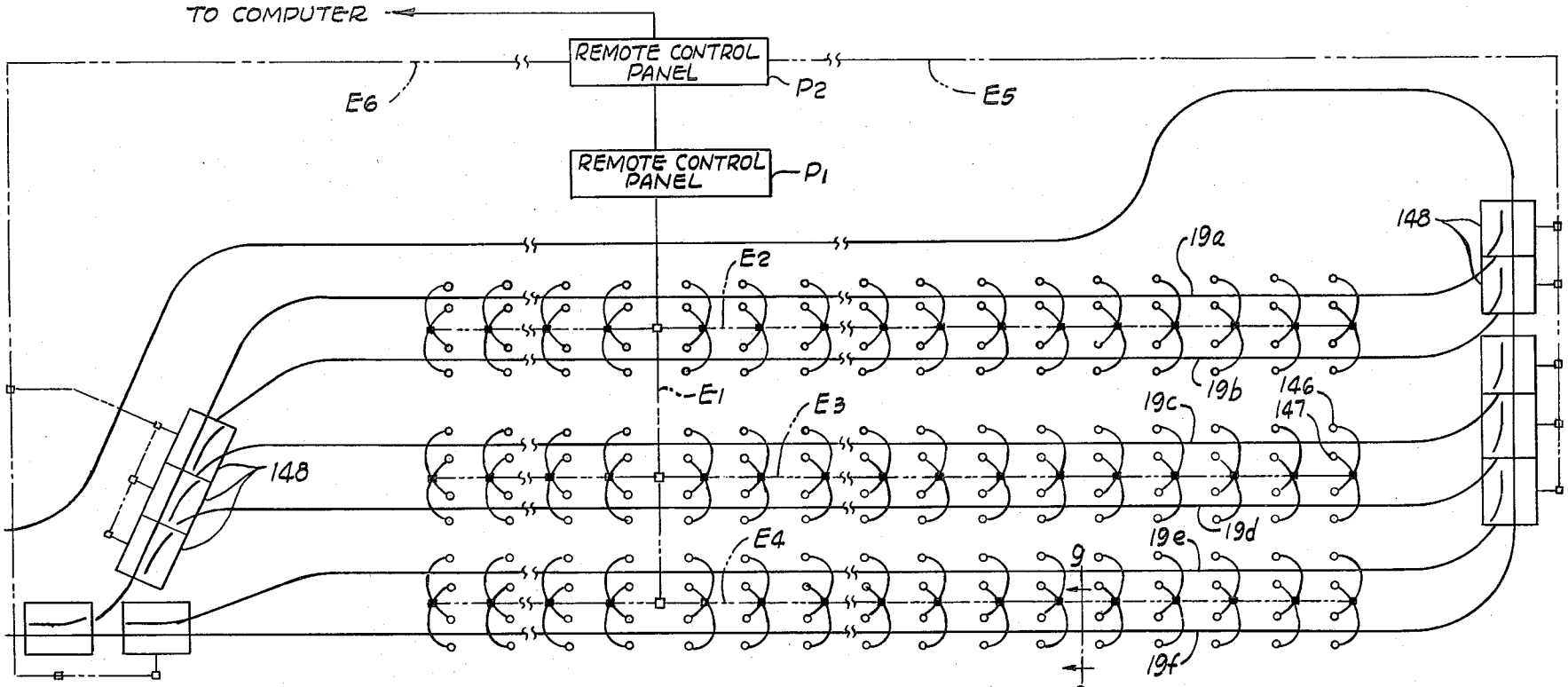
FIG. 8 is a diagrammatic plan view of the secondary cooling or storage zone showing the location of electromagnets for controlling carriers; and, FIG. 9 is a transverse sectional view of a conveyor track of the secondary storage zone taken along the line 9—9 of FIG. 8, showing the location of the electromagnets, power bars and control bars along the track.
Figure 9:
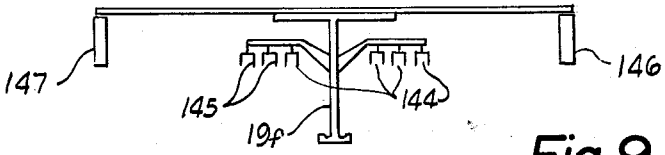

The carrier tracks 19 are shown in dotted line in FIGS. 2A and 2B, and in elevation in FIGS. 1A and 1B. Additional details are shown in FIGS. 8 and 9. The entire track layout in the embodiment shown is located at the lower level of the foundry. The track layout is in the form of a continuous loop through the container exchange shuttle station 142 and the storage zone 20. In addition to a supporting monorail, the track system has overhead power and control bars. Four power bars 144 are provided (including a ground bar) and two control bars 145 to perform control functions for the carriers. One of the control bars transmits signals to the control computer (not shown) to indicate the presence of the carrier, and the other control bar receives speed control signals from the computer. The bars, while continuous are separated electrically into segments of varying length by electrically insulated splices to establish isolated zones that are wired back to the computer to facilitate the automatic control. In this manner, the location of the carriers is monitored and the movement controlled, in conjunction with electromagnets 146, 147 along the tracks in the storage zone to initiate deposit and pick up of containers at various locations.

Six storage paths are provided in the storage zone 20 by parallel track portions **19*a* through 19*f* to provide sufficient space for the molds to be cooled. The number of paths and their length will of course vary with the space available and the capacity required. Various track switches 148, associated with the storage track portions, control which path will be available for a carrier and container in each instance. Each carrier 143 includes a hoist 149 for lifting the container so that a container can be carried along the track at a different level from the stored containers, eliminating the need for lateral movement. In addition, the containers may be stored two high, as shown in FIG. 2**, or may be stored on only one level.

Each carrier 143 has a conventional monorail carriage with an independent motor drive. Operation of the carriage, which is of known construction and the rail switches 148 are controlled by signals from the control computer and by on-board logic circuitry. Thus, a location at which a container with a hot casting is to be stored and the location where a container with a cooled casting is to be retrieved are determined for each carrier by the computer and the carriers are directed to these positions by means of the computer-controlled track switches and so-called "hot" and "cold" position electromagnets 146, 147 that are energized by the computer to control the location within the storage zone at which the carriers stop to pick up or deposit a container. Depending upon the time cycle established, more than one carrier may be on the same storage path at the same time.

When a carrier 143 is loaded at the container exchange shuttle station 142 with a container 17 having a hot casting to be further cooled, the carrier is immediately released from the station and travels to the storage zone 20. The system control computer (or alternatively a manual input) determines the destination of the carrier, i.e., the location at which the load is to be stored, at the time of loading. The computer operates the track switches 148 required to direct the carrier to the selected storage path **19*a–f*. The computer will also energize the proper "hot" deposit and "cold" pickup electromagnets 146, 147**, respectively, on that storage path and the carrier will travel to the selected storage positions where a magnetically operated switch on the carrier will be operated by the energized electromagnets to cause the carrier to deposit the container, pick up another, and return to the container exchange shuttle station. Operation of the carrier in slowing, stopping, lowering and releasing containers and grabbing and raising containers, is under control of the on-board logic circuitry, initiated by magnetic operated limit switches on the carrier, and the manner of such operation is known per se. The direction of carrier movement to a pick up station on the path of travel, after depositing a container with a hot casting, is determined by whether or not the carrier has passed an energized "cold" position electromagnet in reaching its deposit position. If such an electromagnet has been sensed, the carrier will be reversed after deposit, to reach the pick-up position. If not, it will continue forward and stop at the energized "cold" position electromagnet. In all cases the carrier then proceeds forward from the pick-up location out of the storage zone.

The returning carrier will, in turn, reach the loading position at the container exchange shuttle station 142 as the loading position becomes vacated by a previously loaded carrier. At this position, its cooled load (or empty container in some instances) will be exchanged for a container that is carrying a hot casting for movement into the cooling zone, and the cycle is repeated, although this casting may require a different cooling time from the previous casting and may be stored along a different storage path. At a later time, the casting container previously deposited in the cooling zone will be withdrawn by a future carrier trip and delivered back to the container exchange shuttle station.

A suitable computer for controlling the functions described is an IBM Systems 7—External Sensor Based Computer. Programming to accomplish the sequence of operations described is within the ability of those skilled in the art. A limited number of different castings are being produced and, hence, a limited number of different cooling times are required. It is necessary to program the computer to provide for the different cooling times required (e.g., two different times with two different casting patterns as provided in the preferred embodiment shown herein) and the repeating sequence. The computer then assigns the proper cooling time when the casting is taken to the storage area. Suitable electromagnets 146, 147 are General Electric No. CR115 AB 103 XX and suitable magnetic operated limit switches on the carrier are General Electric No. CR115 A 23 AC. As shown in FIG. 8, electromagnets 146, 147 at each storage station along each track portion 19*a–f* are controlled by electrical lines E1, E2, E3, E4 from a remote control panel P1 electrically connected, as diagrammatically shown, to the control computer. The track switches 148 are electrically controlled by lines E5, E6 from a remote control panel P2 electrically connected to the control computer. Depending upon the programmed input to the control panels from the computer, the appropriate track switch 148 is positioned and electromagnets 146, 147 are energized to direct a carrier to the desired storage position and control its operation. The track switches also operate limit switches that operate power contactor relays for power bar safety baffling.

Container Transfer Apparatus

The container transfer apparatus 22 (FIGS. 3 and 5) is located at the container exchange shuttle station 142 for removing a container 17 with a cooled casting from a monorail carrier 143, and for transferring a container 17 with a hot casting from the lowerator 134 to the same carrier. This is accomplished during a dual shuttle apparatus 158 that extends transversely beneath the track 19 of the monorail system 18, from the container lowerator 134 on one side of the track to a shakeout conveyor pickup station 160 on the other side. At the shakeout conveyor pickup station an overhead device 162 serves to transfer containers to the shakeout conveyor 164 of the system 24. The container transfer apparatus includes a shuttle car 165 supported for travel by horizontal rails 166, 167, which are vertically movable together by two actuators 169, 170 at opposite ends. The rails extend on one side of the track 19 to the lowerator 134 and on the other side to the unloading machinery 160. The distance from the track 19 to both the lowerator and the unloading mechanism is equal. The length of the shuttle car 165 is such that when one end of the shuttle car is in the lowerator, positioned to receive a container, the other end is beneath a carrier 143 supported by the track 19, and when the car is moved along the rails so the end that was beneath the lowerator is beneath the track 19, the other end is beneath the overhead device 162.

The shuttle car 165 is gear driven between opposite ends of the rails 166, 167, between the two positions described. As viewed in FIG. 5, when one end 165*a* of the shuttle car is between the sides of the lowerator 134, the other end 165*b* is beneath the track 19. At the other end of shuttle car travel (the position shown in FIG. 5) the end 165*b* is beneath the overhead device 162 and the end 165*a* is beneath the track 19. When the car is in the right hand position as viewed in FIG. 5, the end 165*a* is slightly below the feet of a container 17 supported by the lowerator and the left hand end 165*b* is slightly beneath a container 17 supported by the carrier 143 on the rail 19. The actuators 169, 170 lift the rails 166, 167 and the shuttle car 165 to lift both containers 17 that are above the opposite ends of the car, so that both are supported on the transfer car. The car is then driven to the left end of the rail, to the position shown in FIG. 5, and upon reaching an abutment, causes the actuators to lower the rails so the container 17 of the lowerator is now supported by the carrier 143 and the container 17 from the carrier 143 is now supported by the overhead transfer device 162. The carrier 143 then carries the container 17 with the hot casting to storage, while the overhead transfer device 162 carries the container 17 with a cooled casting to the container return and mold shakeout system 24. Movement of the device 162 is initiated by the lowering of the shuttle car.

As soon as the carrier 143 leaves the container exchange shuttle station 142, a carrier immediately behind it, in a "ready station" is moved into and occupies the loading station, being stopped in accurate position by a limit switch, and the transfer cycle is repeated; i.e., its cooled load is exchanged for a container 17 with a hot casting.

The movements of the carrier 143, the lowerator 134 and the shuttle car 165 are initiated under control of the computer. The carrier 143 at the transfer station delivers a signal to the computer control for the container transfer apparatus as soon as it has positioned itself accurately. Upon receipt of this signal, the computer then determines from external sensors at the transfer station that the lowerator has stopped and the container transfer apparatus is then energized to execute its load exchange function as described. Completion of this exchange generates a release signal that starts the loaded carrier 143 traveling at high speed out of the container exchange shuttle station 142 toward the secondary storage zone 20. A carrier 143 immediately behind the carrier that has just left the container exchange shuttle station was previously stopped at a ready position by virtue of a front end collapsible collision bumper 150 (FIG. 1A) that had contacted the rear end of the previous carrier 143 and operated a switch on the carrier to stop its drive. The switch is now opened and the carrier is driven to leave the ready station and proceeds to the loading station, where it is decelerated by control switches through lower speed points and is then stopped by a limit switch, accurately positioned to receive the next load. A subsequent carrier, previously in an escapement position then proceeds to the ready position, where its front bumper engages the carrier now in the transfer position, and stops. Thus, a plurality of carriers indexes forward each time one leaves the container exchange shuttle station.

In addition to the above operation, there are instances where secondary cooling is not required, as after the foundry has been shut down for a period of time sufficient to allow those castings along the mold conveying line 12 to cool sufficiently for shakeout. In such instance, the shuttle car 165 is used to transfer containers from the lowerator to a carrier 143 and then from the carrier 143 to the overhead device 162, without moving the carrier, i.e., without conveying a container to the storage zone.

Container Return and Mold Shakeout System

The overhead device 162 moves the container 17 it received from the container exchange shuttle car 165 at the pick-up station into a shakeout conveyor input station 174 (FIG. 3), where it deposits the container on a horizontal stub roller conveyor 176 which advances the container to one of two shakeouts 178, 179. The following container will go to the other shakeout. Thus, each shakeout handles only every other casting to reduce the work load on each shakeout and in effect provides reserve shakeout capacity.

A container 17 is positioned along the conveyor 176 at one of the shakeouts 178, 179, where a pushup cylinder (not shown) lifts the bottom of the container to a level slightly above the top surface of the container. A horizontal plow off cylinder (not shown) then sweeps the sand cake and contained casting off of the container bottom and pushes the cake and casting onto a deck of the shakeout. As soon as the plow off is completed, the bottom plate cylinder retracts, lowering the bottom plate back into position in the container. A high pressure air blast is turned on for a short time as the cylinder is retracting, to remove any loose sand and leave the container clean and ready for reloading. As soon as the pushup cylinder fully retracts, the now empty container 17 is moved along the roller conveyor 176 to a control station 180 and onto a transfer car 181, which carries a separable end part **176*a* of the roller conveyor 176. In response to arrival of the container at the control station 180, the transfer car carries conveyor part 176*a* and the container 17 laterally into the chain elevator 74 and positions the empty container for pickup by the elevator bars. The elevator 74 is constructed identically to the lowerator 134, but serves to raise the containers from the lower level to an upper level of the foundry. The transfer car remains in position until the elevator lifts the container high enough to clear the transfer car, at which time a limit switch is actuated by the elevator or alternatively the computer control produces a signal to cause the transfer car to return to its initial position, in line with the roller conveyor 176**.

After the elevator indexes three positions (each with an associated transfer), the empty container reaches the upper level of the foundry. The walking beam conveyor 75 is then extended out between the elevator chain, with its top surface just below the bottom of the container, and makes a short up stroke which lifts the container clear of the elevator support shelves and the beam then strokes in the opposite direction to remove the container from the elevator. After a number of such strokes, the walking beam will have advanced the container to the other end of the beam, away from the elevator, and on the last stroke, the beam will deposit the container in grab arms of the overhead conveyor 78. It will be understood that with each stroke a plurality of containers are advanced along the beam. In response to each stroke of the walking beam conveyor, which deposits a container at the lift-off station 76, operation of the conveyor 78 is initiated to pick up the container, move it horizontally, and deposit it at the feed station 80 of the sand cake transfer system. From there, the container will be advanced by the roller conveyor 82 to receive another sand cake and casting.

At the shakeout units 178, 179, the castings removed from the containers 17 are advanced by oscillations of the units as the sand cake is being shaken off of each casting. After the sand cake has been removed, the operator can control the conveying motion so that the castings are, in effect, stopped. Chains, slings or hooks are then attached to pick up the castings and move or transfer them from the shakeout units.

While a preferred embodiment of the invention has been described in detail, it will be apparent that various modifications or alterations may be made therein without departing from the spirit and scope of the invention set forth in the appended claims.

What is claimed is:

1. In a foundry:

sand molds, including sand cakes and surrounding flasks, for receiving molten metal to form metal castings, containers for carrying a sand cake and casting after removal of the flask, first conveying means for carrying sand molds along a path a portion of which is used for filling molds and a subsequent portion of which, considered in the direction of mold travel, is used for primary cooling of the castings, second conveying means for bringing empty containers to a first transfer location adjacent the subsequent portion of the path of the first conveying means, sand cake transfer means at the first transfer location, for removing a sand mold from the first conveying means, for removing the sand cake and casting from the flask, and for transferring the sand cake and casting to an empty container while maintaining the integrity of the sand cake, a storage zone where castings and sand cakes in containers are received and stored for further cooling of the castings, third conveying means for taking containers with castings from the sand cake transfer means to a second transfer location where containers with castings are transferred between conveying means, fourth conveying means for carrying containers with castings from the second transfer location to the storage zone and for carrying containers with cooled castings from the storage zone without limitation to the order in which the containers were brought into the storage zone, and fifth conveying means for taking containers with cooled castings from the fourth conveying means to a container unloading means.

2. In a foundry:

sand molds, including sand cakes and surrounding flasks, for receiving molten metal to form metal castings, containers for carrying a sand cake and casting after removal of the flask, first conveying means for carrying sand molds along a path a portion of which is used for filling molds and a subsequent portion of which, considered in the direction of mold travel, is used for primary cooling of the castings, second conveying means for bringing empty containers to a first transfer location adjacent the subsequent portion of the path of the first conveying means, sand cake transfer means at the first transfer location, for removing a sand mold from the first conveying means, for removing the sand cake and casting from the flask, and for transferring the sand cake and casting to an empty container while maintaining the integrity of the sand cake, a storage zone where castings and sand cakes in containers are received and stored for further cooling of the castings, third conveying means for taking containers with castings from the sand cake transfer means to a second transfer location where containers with castings are transferred between conveying means, fourth conveying means for carrying containers with castings between the storage zone and the second transfer location, fifth conveying means for taking containers with castings from the second transfer location to a container unloading means, and transfer means at the second transfer location for transferring containers from the third conveying means to the fourth conveying means and from the fourth conveying means to the fifth conveying means.

3. The apparatus as set forth in claim 2 wherein said transfer means at the second transfer location includes means to concurrently engage containers carried by the third and fourth conveying means and concurrently transfer the engaged containers from the third to the fourth and from the fourth to the fifth conveying means.

4. In a foundry:

first conveying means for carrying sand molds and hot castings along a primary cooling path to a casting transfer location, second conveying means in part adjacent the first conveying means for carrying empty containers past the transfer location, where sand molds and hot castings are transferred to and thereafter carried by the containers, third conveying means, downstream from said second conveying means in the direction of container travel, for receiving containers with sand molds and hot castings after the transfer at the transfer location and for carrying them to a storage area for secondary cooling of castings and for bringing containers with sand molds and cooled castings from the storage area, said third conveying means for carrying sand molds and castings to and from the storage area being an overhead monorail conveyor having individually driven carriers operable to select containers from the storage area out of a sequence in which the containers were carried to the storage area, and fourth conveying means in part adjacent the third conveying means for receiving containers brought from the storage area by the third conveying means concurrently upon the third conveying means receiving containers with hot castings.

5. In a foundry:

first conveying means for moving mold cars along a predetermined closed path, which path includes a portion along which sand molds are received, a portion along which the molds are filled, and a portion along which castings are partially cooled, a transfer station along said first conveying means, including means for removing sand molds from the mold cars and means for transferring the sand molds to a container that maintains the integrity of the mold while facilitating cooling, at a location subsequent to the portion of the path along which the castings are partially cooled, means providing a storage area for further cooling of castings in the sand molds and containers for a time independent of any conveying path length, a shake out station, including means for removing cooled castings from the molds, and further conveying means for carrying partially cooled sand molds in containers from the transfer station to the storage area and for carrying completely cooled sand molds in containers from the storage area to the shake out station.

6. In a foundry:

sand molds, including sand cakes and surrounding flasks, for receiving molten metal to form metal castings, containers for carrying a sand cake and casting after removal of the flask, first conveying means for carrying sand molds along a path a portion of which is used for filling molds and a subsequent portion of which, considered in the direction of mold travel, is used for primary cooling of the castings, second conveying means for bringing empty containers to a transfer location adjacent the subsequent portion of the path of the first conveying means, sand cake transfer means at the transfer location, for removing a sand mold from the first conveying means, for removing the sand cake and casting from the flask, and for transferring the sand cake and casting directly into an empty container while continuously engaging top, bottom and side surfaces of the sand cake, thereby maintaining the integrity of the sand cake, and third conveying means adjacent said transfer location for taking containers with castings from the sand cake transfer means.

7. In a foundry as set forth in claim 6, wherein said sand cake transfer means includes movable means to engage a top and bottom surface of a sand cake to move in coordinated fashion downward to carry a sand cake from a surrounding flask into a surrounding container with the sides of the sand cake continually engaged.

8. In a method of making castings, the steps comprising:

assembling sand molds, including sand cakes and surrounding flasks, for receiving molten metal to form metal castings, providing containers for carrying a sand cake and casting after removal of the flask, conveying sand molds along a path a portion of which is used for filling molds and a subsequent portion of which, considered in the direction of mold travel, is used for primary cooling of the castings, bringing empty containers to a transfer location adjacent the subsequent portion of the path, removing the sand cake and casting from the flask and transferring the sand cake and casting directly into an empty container at the transfer location while continuously engaging top, bottom and side surfaces of the sand cake, thereby maintaining the integrity if the sand cake, and further cooling the casting within the sand cake.

9. In a method of making castings, the steps comprising:

providing a sand mold and surrounding flask, carrying the mold along a path, pouring metal into the mold while it is moved along the path to form a casting, moving the mold along the path subsequent to the pouring to allow primary cooling, removing the surrounding flask and transferring the mold to a container that maintains the integrity of the mold while facilitating cooling, transferring the mold in the container after primary cooling to a conveyor for moving the container and mold to a storage zone, moving the container and mold transferred to the conveyor to the storage zone and leaving them there for a period of time for secondary cooling of the mold and casting, removing a different container and mold from the storage zone in an order or sequence different, relative to other containers and molds, from the order in which said different container and mold were moved into the zone, which different container, mold and casting have been in said storage zone for a period of time for secondary cooling, and thereafter removing the cooled casting from the mold.

10. In a method of making castings, the steps comprising:

providing a sand mold and surrounding flask, carrying the mold along a path, pouring metal into the mold while it is moved along the path to form a casting, moving the mold along the path subsequent to the pouring to allow primary cooling, removing the flask from the mold, providing a container for the mold, placing the mold after primary cooling and after flask removal into a container while maintaining the integrity of the mold, transferring the container with the mold after primary cooling to a conveyor for moving the container to a storage zone, moving the container transferred to the conveyor to the storage zone and leaving it there for a period of time for secondary cooling of the mold and casting, removing a different container from the storage zone, which different container and its contained mold and casting have been in said storage zone for a period of time for secondary cooling independent of the time other molds and castings have been in the storage zone, and thereafter removing the cooled casting from the different container.

11. In a method of making castings, the steps comprising:

providing a sand mold and surrounding flask, carrying the mold along a path, pouring metal into the mold while it is moved along the path to form a casting, moving the mold along the path subsequent to the pouring to allow primary cooling, removing the flask from the mold, providing a container for the mold, placing the mold after primary cooling and after flask removal into a container while maintaining the integrity of the mold, transferring the container with the mold after primary cooling to a conveyor for moving the container to a storage zone and transferring from the same conveyor a container with a mold taken from the storage zone, moving the container transferred to the conveyor to the storage zone and leaving it there for a period of time for secondary cooling of the mold and casting, moving the conveyor and a different container from the storage zone, which different container and its contained mold and casting have been in said storage zone for a period of time for secondary cooling independent of the time other molds and castings have been in the storage zone, and thereafter removing the cooled casting from the different container.

12. In a method of making castings, the steps comprising:

carrying a mold and a surrounding flask along a path, pouring metal into the mold while it is moved along the path to form a casting, moving the mold along the path subsequent to the pouring to allow primary cooling, removing the flask from the mold, providing a container for the mold, placing the mold after primary cooling and after flask removal into a container while maintaining the integrity of the mold, transferring the container with the mold after primary cooling to a conveyor for moving the container to a storage zone and concurrently transferring from the same conveyor a container with a mold from the storage zone, moving the container transferred to the conveyor to the storage zone and leaving it there for a period of time for secondary cooling of the mold and casting, moving the conveyor and a different container from the storage zone, which different container and its contained mold and casting have been in the storage zone for a period of time for secondary cooling independently of the time other molds and castings have been in the storage zone, and thereafter removing the cooled casting from the different container.

13. In a method of cooling metal castings in sand molds, the steps comprising:

providing a series of monorail carriers and an overhead track for supporting and guiding the carriers, advancing carriers with containers having hot castings in sand molds to a transfer station, transferring a first container to a carrier at the transfer station in response to the positioning of a carrier at the transfer station, moving the loaded carrier from the transfer station toward a cooling zone, directing the loaded carrier through controlled track switches to a selected location at the cooling zone and depositing the first container at the selected location utilizing automatic control means associated with the carrier and overhead track, moving the carrier to a second container at a second location at the cooling zone and picking up the second container, moving the carrier and second container to the transfer station, transferring the second container and casting from the carrier, and unloading the container.

14. In a method of cooling metal castings in sand molds, the steps comprising:

providing a series of monorail carriers and an overhead track for supporting and guiding the carriers, advancing carriers with containers having hot castings in sand molds to a transfer station, transferring a first container with a hot casting in a sand mold to a carrier at the transfer station in response to the positioning of a carrier at the transfer station, moving the loaded carrier from the transfer station toward a cooling station, directing the loaded carrier through controlled track switches to a selected location at the cooling station and depositing the first container at the selected location utilizing automatic control means associated with the carrier and overhead track, moving the carrier to a second container having a cooled metal casting in a sand mold at a second location at the cooling station and picking up the second container, moving the carrier and second container to the transfer station, transferring the second container and cooled casting and sand mold from the carrier while concurrently transferring a container and hot casting in a sand mold to the carrier, and unloading the container.

15. In a foundry:

sand molds for receiving molten metal, first conveying means, including mold cars that support the sand molds, for moving the molds along a predetermined closed path including a portion along which the molds are filled and a portion along which castings are partially cooled, transfer means at a location along said first conveying means for removing sand molds from the mold cars and for transferring the molds to containers that maintain the integrity of the molds while facilitating cooling, said location being subsequent to the portion of the path along which the castings are partially cooled, means providing a storage area for further cooling of castings in the contained sand molds for a time independent of any conveying path length, and further conveying means for carrying partially cooled molds in the containers from the transfer means to the storage area and for carrying completely cooled molds in the containers from the storage area without being limited in the carrying of molds from the storage area to the order in which the molds were brought to the storage area.

16. A method of making castings, comprising the steps of: pouring metal into a sand mold while it is moved along a path to form a casting, moving the mold along the path subsequent to the pouring to allow primary cooling, transferring the mold after primary cooling to a container that maintains the integrity of the mold while facilitating cooling and transferring the container and mold to a conveyor for moving the container and mold to a storage zone and transferring from the same conveyor a container and mold taken from the storage zone, moving the container and mold transferred to the conveyor to the storage zone and leaving them there for secondary cooling of the mold and casting for a period of time independent of the time during which any other mold is in the storage zone, moving the conveyor and a different container and mold from the storage zone, which different container, mold and casting have been in said storage zone for a period of time for secondary cooling, and thereafter removing the cooled casting from the mold.

17. Apparatus for making castings, comprising: an automatic foundry system which includes sand molds, including sand cakes and surrounding flasks, for receiving molten metal to form metal castings, and containers for carrying a sand cake and casting after removal of the flask; means for carrying sand molds along a path, a portion of which is used for filling molds and a subsequent portion of which is used for primary cooling of the castings; sand cake transfer means at a first location adjacent the subsequent portion of the path for removing the flask and transferring the sand cake to a container while maintaining the integrity of the sand cake; and means for transferring castings in containers to and from a storage zone where castings and sand cakes in containers are deposited and stored for further cooling of the castings.

18. In a method of making castings, the steps comprising:

providing a sand mold and surrounding flask, carrying the mold along a path, pouring metal into the mold while it is moved along the path to form a casting, moving the mold along the path subsequent to the pouring to allow primary cooling, removing the flask from the mold, providing a container for the mold, placing the mold after primary cooling and without the flask into a container while maintaining the integrity of the mold, transferring the container and mold to a storage zone and leaving the container and mold there for a period of time for secondary cooling of the mold and casting, and removing a different container and mold from the storage zone in an order or sequence different, relative to other containers and molds, from the order in which the container and mold was moved into the zone, which different mold has been in said storage zone for a period of time for secondary cooling.

* * * * *